US008357863B1

(12) United States Patent
Yang

(10) Patent No.: US 8,357,863 B1
(45) Date of Patent: Jan. 22, 2013

(54) PUSH HANDLE SWITCH LAMPHOLDER

(75) Inventor: Wen Ho Yang, New Taipei (TW)

(73) Assignee: Rich Brand Industries LImited, Dongguan, Guangdong Province (CN)

( * ) Notice: Subject to any disclaimer, the term of this patent is extended or adjusted under 35 U.S.C. 154(b) by 17 days.

(21) Appl. No.: 13/215,422

(22) Filed: Aug. 23, 2011

(51) Int. Cl.
*H01R 33/22* (2006.01)

(52) U.S. Cl. ..... 200/51.09; 362/441

(58) Field of Classification Search ..... 200/51.09, 200/51.14, 51.16; 362/441, 435
See application file for complete search history.

(56) References Cited

U.S. PATENT DOCUMENTS 3,798,440 A * 3/1974 Brindley ..... 362/205
4,504,713 A * 3/1985 Hennessey ..... 200/241
5,260,858 A * 11/1993 Maglica ..... 362/205
8,142,058 B2 * 3/2012 Yang ..... 362/441

* cited by examiner

*Primary Examiner* — Gary F. Paumen
(74) *Attorney, Agent, or Firm* — Bacon & Thomas, PLLC

(57) ABSTRACT

The present invention provides a push handle switch lampholder push handle switch lampholder that pushes a lower conductive plate to move like a see-saw by pushing a push handle to move back and forth and determines whether or not to pass a current to an upper conductive plate, so as to control the ON or Off of a light emitting element. The invention can reduce the number of components and the total volume while achieving the effects of easily controlling whether or not to light the light emitting element, lowering the manufacturing, warehouse storage and transportation costs, and improving the overall service life of the lampholder.

4 Claims, 4 Drawing Sheets

PUSH HANDLE SWITCH LAMPHOLDER

BACKGROUND OF THE INVENTION

1. Field of the Invention

The present invention relates to a push handle switch lampholder, and more particularly to the push handle switch lampholder that pushes a lower conductive plate to move like a see-saw by pushing a push handle to move back and forth and determines whether or not to pass a current to an upper conductive plate, so as to control the ON or Off of a light emitting element.

2. Description of the Related Art

As light bulb was introduced in 1879, it becomes a necessary illumination device for our life. In the use of the light bulb, a lampholder must be installed to act as a support and supply electric power, so that the lampholder is an important item for the use of the light bulb. In general, a conventional lampholder is operated by pressing a switch, and the lampholder is mainly divided into four types including a switchless lampholder (wherein the switch is installed on a power supply line), a knob switch lampholder, a zipper switch lampholder and a push handle switch lampholder.

With reference to FIG. 1 for a conventional push handle switch lampholder 1, the push handle switch lampholder 1 comprises a cylindrical shell 11, an insulating plate 12, an insulating base 13 and a push handle switch 14, wherein the cylindrical shell 11 is made of a conductive plate into a substantially cylindrical shape and having a threaded mouth for screwing and connecting a light emitting element such as a light bulb (not shown in the figure), and a first electrode of the light emitting element is contacted with cylindrical shell 11 to electrically couple to a negative electrode of the power supply such as a utility power supply (not shown in the figure), and the second electrode of the light emitting element is electrically turned to an ON position by the switch 14 to electrically couple to a positive electrode of the power supply, so as to emit lights by the circuit conduction. However, if the switch 14 is switched to an OFF position, the light emitting element will be turned off. The insulating plate 12 is installed at the bottom of the cylindrical shell 11, and a connecting groove 120 is formed thereon.

The insulating base 13 is installed under the insulating plate 12 and includes a containing groove 130 concavely formed on the insulating base 13 for embedding a negative electrode plate 131 and a positive electrode plate 132, and an end of the negative electrode plate 131 is extended to the top of the insulating base 13 and abutted against the bottom of the insulating plate 12, and the cylindrical shell 11, the insulating plate 12, the negative electrode plate 131 and the insulating base 13 are pivotally coupled, so that the negative electrode plate 131 and the cylindrical shell 11 are electrically connected, and the other end of the negative electrode plate 131 is connected to an exposed end of the power supply line, such that the negative power supply can be connected to the light emitting element. The positive electrode plate 132 includes a lower conductive plate 132*a*, at least two trigger plates 132*b* and an upper conductive plate 132*c*, and the lower conductive plate 132*a* is embedded into the insulating base 131. Since the exposed end of the power supply line is electrically coupled to the positive power supply, the trigger plates 132*b* are contained in both sides of the containing groove 130 respectively, and one of the trigger plate 132*b* proximate to the lower conductive plate 132*a* is electrically coupled to the lower conductive plate 132*a*, and the other trigger plate 132*b* is electrically coupled to the upper conductive plate 132*c*, and the upper conductive plate 132*c* is passed out of the connecting groove 120 and contacted with the second electrode of the light emitting element.

The switch 14 includes a push handle 141, a spring 142 and a metal plate 143, and the push handle 141 has a shape matched with the containing groove 130 for performing a pushing action reciprocally in the containing groove 130, and a middle section of the push handle 141 is hooked to an end of the spring 142. The metal plate 143 is substantially C-shaped, and an internal edge of the lower section is latched to the middle section of the push handle 141, and an internal edge of the upper section is hooked to the other end of the spring 142, so that when the push handle is pushed, the push handle is driven by an elastic force of the spring 142 to tilt towards one of the ends of the push handle 141. In FIG. 2, when the metal plate 143 is tilted towards an end of the push handle 141, the metal plate 143 is contacted with the trigger plates 132*b* on both sides respectively, so that the light emitting element is electrically connected to the positive power supply to emit light. However, when a user pushes the push handle 141 to move and drive the spring 142 to link the metal plate 143 to tilt towards the other end of the push handle 141, and the metal plate 143 will be separated from the contact of the trigger plates 132*b* on both sides, so that the light emitting element is turned off. By pushing the push handle 141 reciprocally, the user can control the circuit connection between the lampholder 1 and the light emitting element to be turned ON or OFF.

Although the aforementioned conventional push handle switch lampholder 1 is a common daily item, its manufacture and usage still have the following drawbacks:

(1) Difficult Assembly: Since the lampholder 1 uses a number of conductive plates for conducting current to the light emitting element, therefore the overall assembling operation is complicated and tedious, and the position may be shift easily by an external force to affect the effect of the lampholder 1, so that the convention lampholder 1 incurs a high manufacturing cost and many manufacturing issues.

(2) Large Volume: Since the whole switch 14 must be accommodated into the containing groove 130, therefore the insulating base 13 is limited and its volume cannot be reduced effectively. As a result, the cost for the injection molding process of the insulating base 13 is high, and the large volume will also affect the warehouse storage and transportation costs.

(3) Unsmooth Pushing Operation: When a user pushes the push handle 141, a force greater than the elastic force of the spring must be applied to the push handle 141 before the metal plate 143 is driven to contact with or separate from the positive electrode plates 132 on both sides. If the elastic force of the spring 142 is too large, then the user has to push the push handle 141 inconveniently. If the elastic force of the spring 142 is too small, then the push handle 141 will be too loose to cause a wrong movement. In addition, the spring 142 may become elastically fatigue after a long time of use, so as to affect the operation and effect of the lampholder 1.

(4) Short Service Life: Since the metal plate 14 and the trigger plate 132*b* are contacted to allow a current flow, and the contact position is a point or a line, the metal plate 143 produces a high temperature and becomes deteriorated or broken after a long time of use, so as to shorten the service life of the lampholder 1.

SUMMARY OF THE INVENTION

In view of the shortcomings of the prior art, the inventor of the present invention based on years of experience in the related industry to design the present invention. Therefore, it is a primary objective of the present invention to overcome the shortcomings of the conventional push handle switch lampholder by providing a push handle switch lampholder capable of simplifying the components and reducing the volume, while achieving the effects of controlling the light emitting element to emit light easily, lowering the manufacturing, warehouse storage and transportation costs, and improving the service life.

To achieve the aforementioned objective, the present invention provides a push handle switch lampholder, comprising: a cylindrical shell, formed by a conductive plate into a substantially cylindrical shape, and having a threaded mouth, and a containing space separately formed at the top and bottom of the interior of the cylindrical shell for screwing and connecting a light emitting element, such that a first electrode of the light emitting element is attached to the cylindrical shell for an electric conduction; an insulating plate, installed at the bottom of the cylindrical shell, and having a connecting groove for passing and embedding an upper conductive plate, and the top of the insulating plate being exposed from the top end of the upper conductive plate and extended into the containing space of the cylindrical shell, and contacted with a second electrode of the light emitting element for an electric conduction, and the other end of the upper conductive plate being extended to the bottom of the insulating plate; an insulating base, installed at the bottom of the insulating plate, and having a containing grove concavely formed at the top of the insulating plate and with a level penetrating through the top of the insulating plate; a push handle, with a shape matched with the containing groove for being installed into the containing groove and performing a reciprocating push movement along the containing groove, and the push handle having a protruding portion protruded thereon; and a lower conductive plate, being substantially in a curved shape matched with the top edge of the containing groove for being movably fixed at a position of the containing groove corresponding to the protruding portion; thereby, in the process of performing the reciprocating push movement by the push handle, the protruding portion of the push handle abuts a position proximate to the lower conductive plate, such that an end of the upper conductive plate is moved in a direction towards the upper conductive plate and contacted with the upper conductive plate to electrically connect and light up the light emitting element, and when the protruding portion abuts a position proximate to the other end of the lower conductive plate, an end of the lower conductive plate is moved in a direction away from the upper conductive plate and separated from the upper conductive plate to electrically disconnect and turns off the light emitting element.

In the aforementioned push handle switch lampholder, the insulating base includes a positive electrode plate and a negative electrode plate embedded into both sides of the containing groove respectively, and an end of the positive electrode plate is exposed from the top of the insulating base and extended to a position of the top of the containing groove proximate to the lower conductive plate, and the other end of the positive electrode plate is electrically coupled to a positive power supply line, and an end of the negative electrode plate is extended out from the top of the insulating base, and the other end of the negative electrode plate is electrically coupled to a negative electrode power line W1.

The aforementioned push handle switch lampholder further comprises a connecting element, and at least one hole formed at corresponding position of the cylindrical shell, the insulating plate and the insulating base for passing the connecting element to secure the cylindrical shell, the insulating plate and the insulating base.

In the aforementioned push handle switch lampholder, the negative electrode plate is extended from a terminal at the top of the insulating base to a hole formed on the insulating base and proximate to the negative electrode plate, such that after the connecting element is passed through the hole, a terminal of the negative electrode plate is electrically coupled to the connecting element.

DETAILED DESCRIPTION OF THE PREFERRED EMBODIMENTS

The technical characteristics and effects of the present invention will become apparent with the detailed description of preferred embodiments accompanied with the illustration of related drawings of the present invention as follows.

Figure 1:
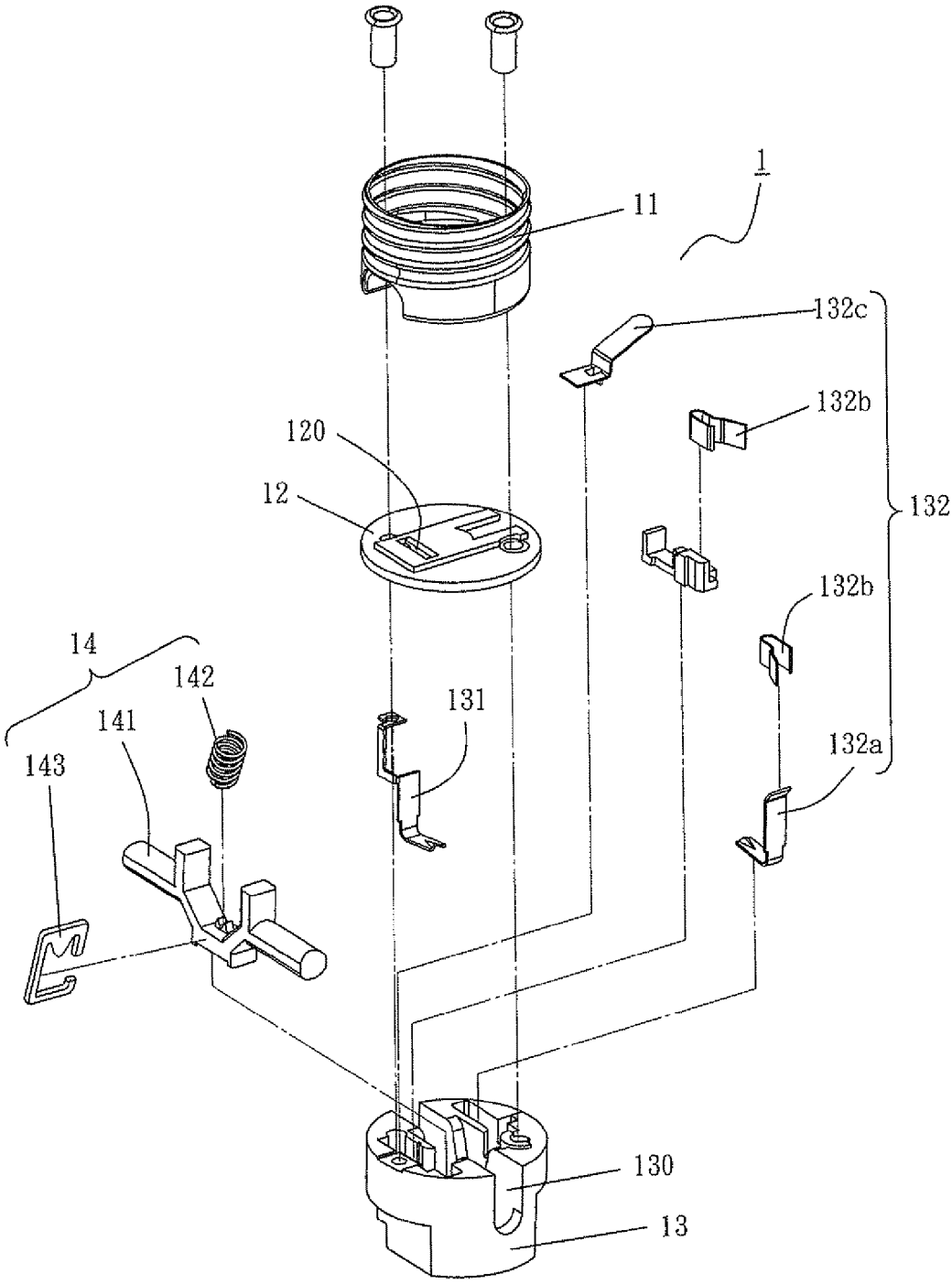
FIG. 1 is an exploded view of a conventional lampholder.
Figure 2:
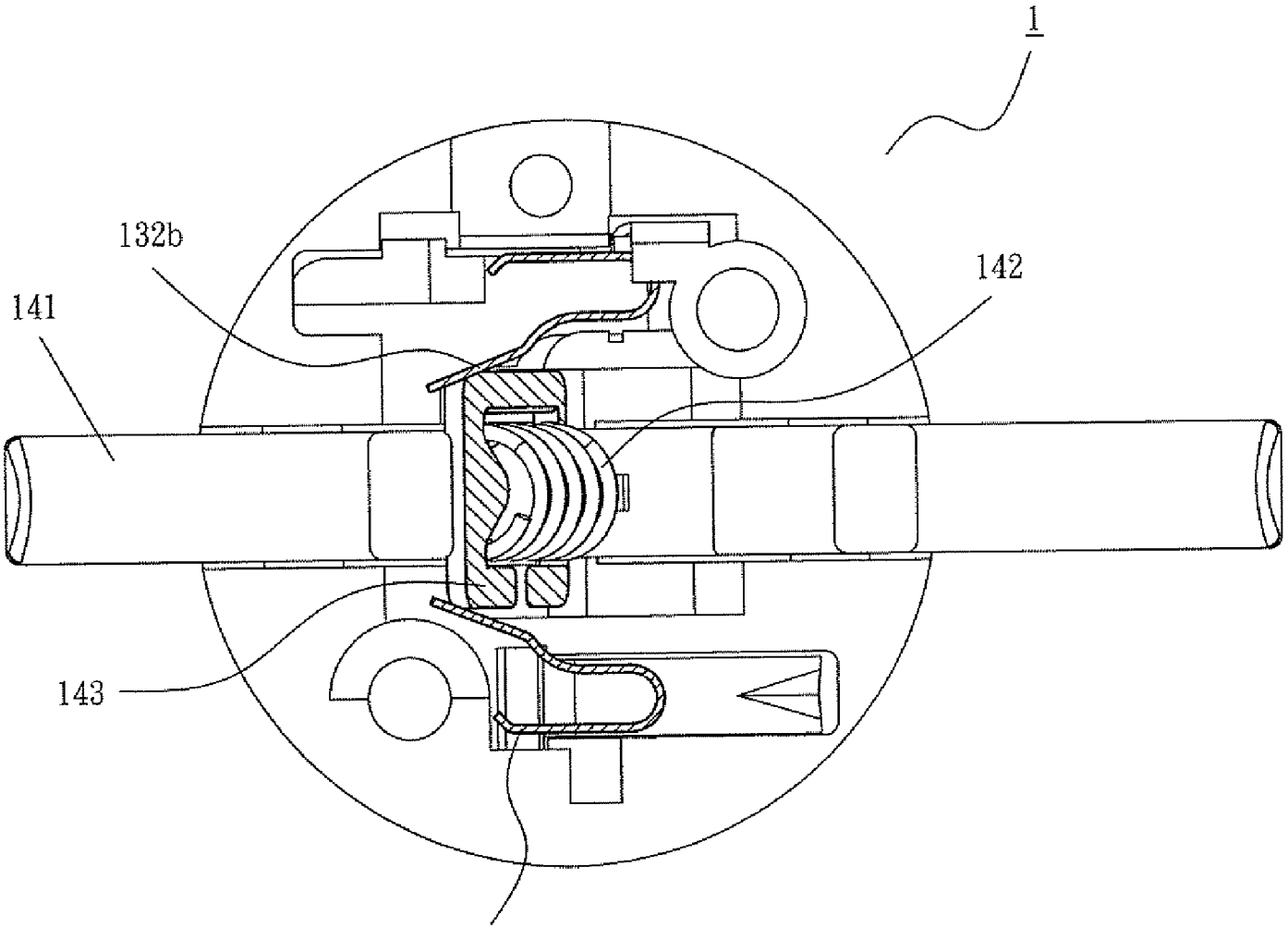
FIG. 2 is a schematic view of movements of a conventional lampholder.
Figure 3:
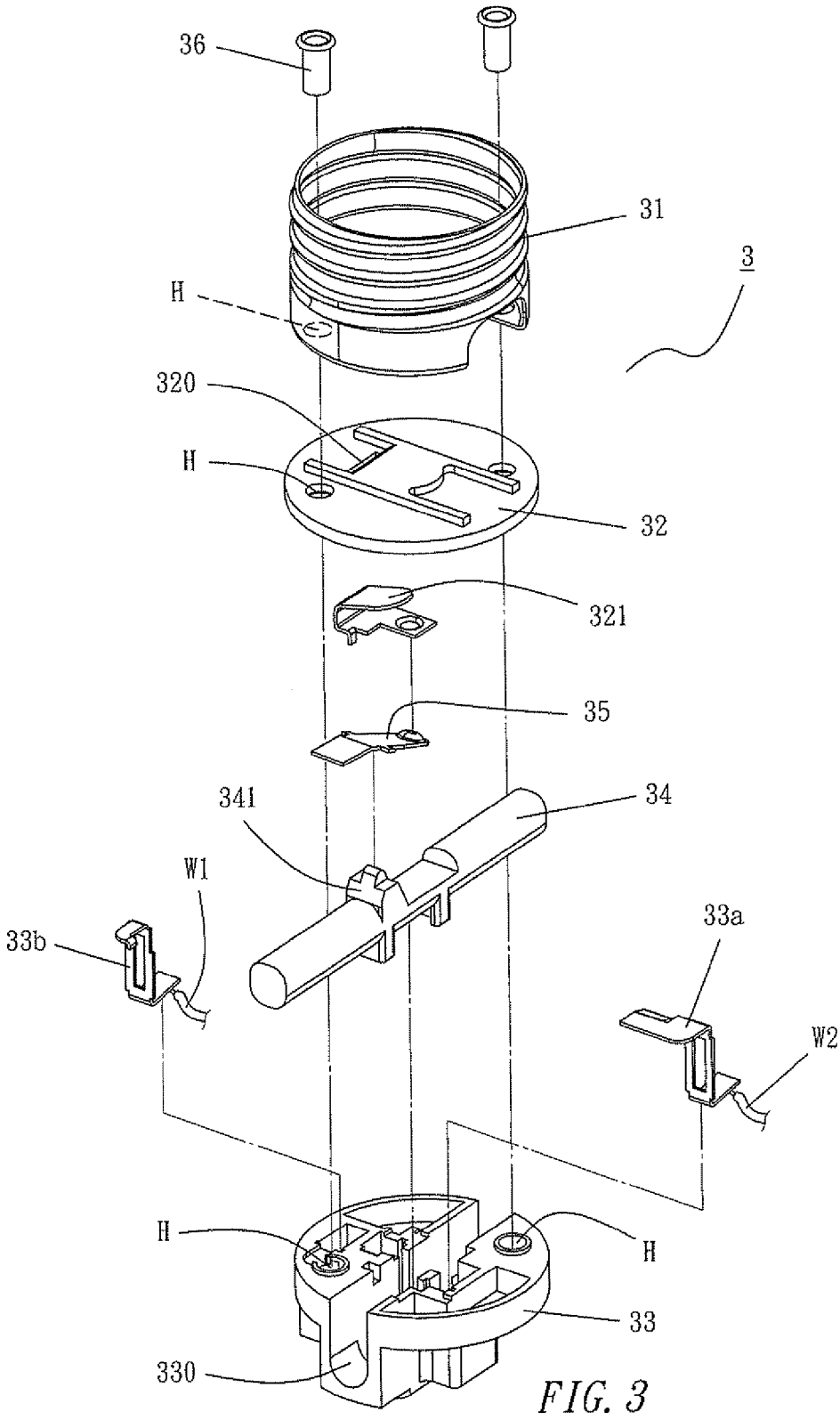
FIG. 3 is an exploded view of a preferred embodiment of the present invention.

With reference to FIG. 3 for an exploded view of a push handle switch lampholder in accordance with a preferred embodiment of the present invention, the push handle switch lampholder comprises a cylindrical shell 31, an insulating plate 32, an insulating base 33, a push handle 34, a lower conductive plate 35 and a connecting element 36, wherein the cylindrical shell 31 is made of a conductive plate and substantially in a cylindrical shape with a threaded mouth and a containing space formed at the top and the bottom of the cylindrical shell 31 separately and provided for screwing and connecting a light emitting element such as a light bulb (not shown in the figure), so that a first electrode of the light emitting element is attached and contacted with the cylindrical shell 31 to define an ON state. The insulating plate 32 is installed at the bottom of the cylindrical shell 31, and a connecting groove 320 is formed for passing and embedding an upper conductive plate 321, and the top end of the upper conductive plate 321 is exposed from the top of the insulating plate 32 and extended into the containing space of the cylindrical shell 31 and contacted with and electrically coupled to the second electrode of the light emitting element, and the other end of the upper conductive plate 321 is extended to the bottom of the insulating plate 32.

With reference to FIG. 3, the insulating base 33 is installed at the bottom of the insulating plate 32, and includes a containing groove 330 concavely formed at the top of the insulating plate 32 with a level penetrated through the top of the insulating plate 32. The push handle 34 is in a shape matched with the containing groove 330 to facilitate its installation in the containing groove 330, and a reciprocating push movement can be performed along the containing groove 330, and the push handle 34 includes a protruding portion 341 protruded from the push handle 34. The lower conductive plate 35 is substantially in a curved shape matched with the top edge of the containing groove 330, so that the conductive plate 35 can be movably fixed at the top edge of the containing groove 330 and at a position proximate to the protruding portion 341.

With reference to FIG. 3, the insulating base 33 includes a positive electrode plate 33*a* and a negative electrode plate 33*b* embedded into both sides of the containing groove 330 respectively, and an end of the positive electrode plate 33*a* is exposed from the top of the insulating base 33 and extended to the top of the containing groove 330 and at a position proximate to the lower conductive plate 35, and the other end of the positive electrode plate 33*b* is electrically coupled to a positive power supply line W2. An end of the negative electrode plate 33*b* is extended out from the top of the insulating base 33, and the other end is electrically coupled to a negative electrode power line W1, wherein the connecting element 36 is a rivet, a screw, or an electrically conductive object used for connection, but the present invention is not limited to these arrangements only. At least one hole H is formed separately at corresponding positions of the cylindrical shell 31, the insulating plate 32 and the insulating base 33, and the holes H are provided for passing through the connecting element 36 to secure the cylindrical shell 31, the insulating plate 32 and the insulating base 33. A terminal of the negative electrode plate 33*b* extended from an end of the top of the insulating base 33 is extended into the hole H of the insulating base 33 proximate to the negative electrode plate 33*b*. After the connecting element 36 is passed through the hole H, a terminal of the negative electrode plate 33*b* can be electrically coupled to the connecting element 36.

Figure 4:
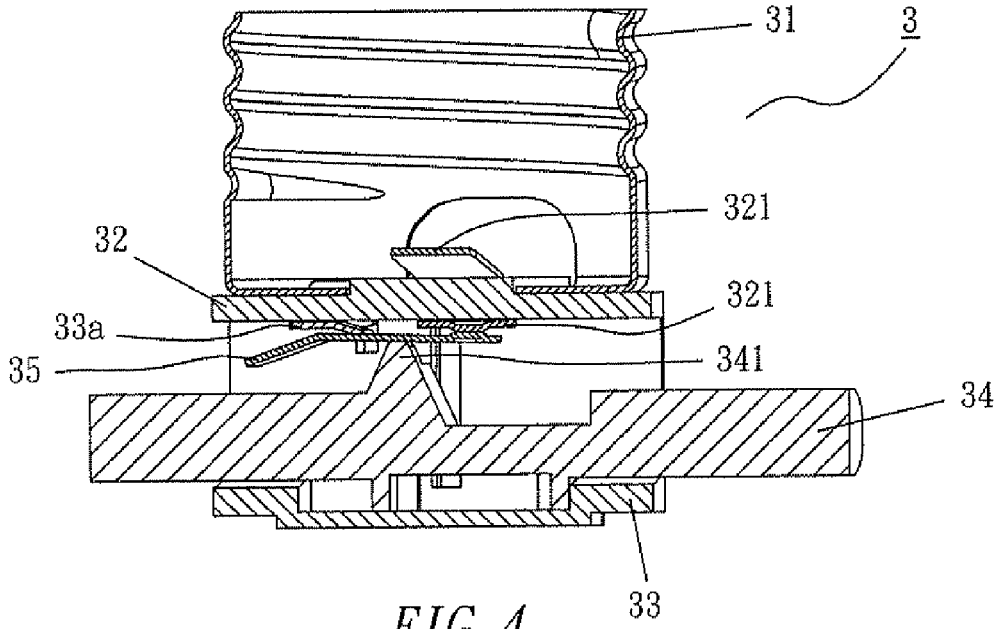
FIG. 4 is a schematic view of a circuit situated at an ON state in accordance with a preferred embodiment of the present invention.

After the lampholder 3 of the present invention is assembled, an insulating casing (not shown in the figure) is sheathed onto an external surface of the lampholder 3 to facilitate the user to touch by hands. However, the casing is not related to the subject matter of the present invention, and thus will not be described here. After the lampholder 3 of the present invention is assembled, and the light emitting element is screwed into cylindrical shell 31 for a fixation, the user can push the push handle 34 to move towards a side of the containing groove 330 as shown in FIG. 4, such that the protruding portion 341 of the push handle 34 pushes against a position proximate to an end of the lower conductive plate 35, such that the lower conductive plate 35 can be swung by using the top edge of the containing groove 330 as a fulcrum, such that one of the ends is moved in a direction towards the upper conductive plate 321 and attached and electrically conducted to the upper conductive plate 321 (as shown in FIG. 4). Now, the positive power supply line W2 is turned ON and electrically coupled to the second electrode of the light emitting element through the positive electrode plate 33*a*, the lower conductive plate 35 and the upper conductive plate 321, and the negative electrode power line W1 is electrically coupled to the first electrode of the light emitting element through the negative electrode plate 33*b*, the connecting element 36 and the cylindrical shell 31, so that the light emitting element will light up due to the circuit connection.

Figure 5:
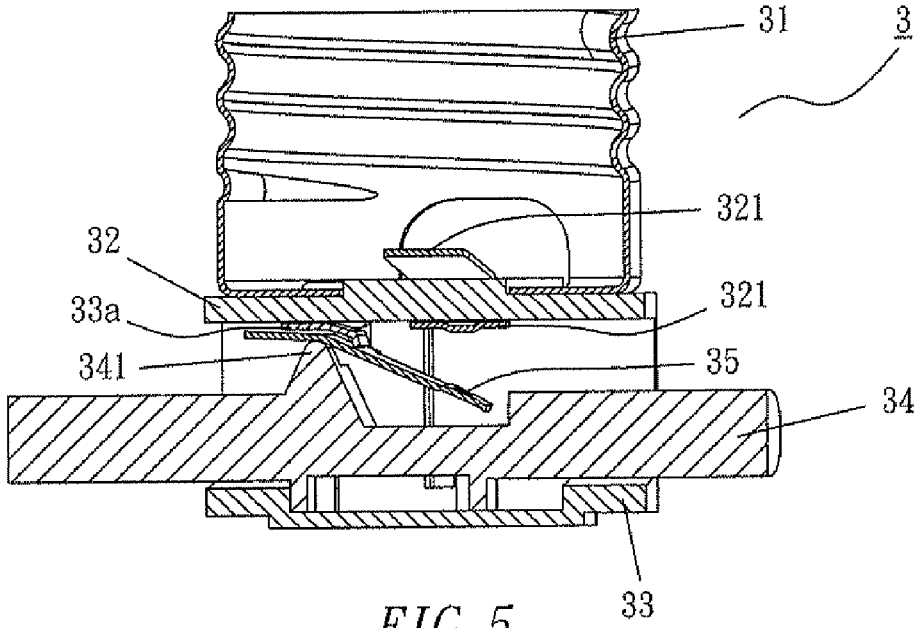
FIG. 5 is a top view of schematic view of a circuit situated at an OFF state in accordance with a preferred embodiment of the present invention.

With reference to FIG. 5, the user pushes the push handle 34 to move towards the other side of the containing groove 330, the protruding portion 341 will push and abut at a position of the lower conductive plate 35 proximate to the other end, such that the lower conductive plate 35 can be swung by using the top edge of the containing groove 330 as a fulcrum, so that one of the ends is moved in a direction away from the upper conductive plate 321 to separate the contact with the upper conductive plate 321 (as shown in FIG. 5), so that the positive power supply line W2 and the second electrode of the light emitting element are electrically disconnected to an OFF state, and the light emitting element is turned off due to the circuit disconnection. By pushing the push handle 34 to move reciprocally, the user can control and determine whether or not to emit light from the light emitting element.

In the assembly of the present invention, the lower conductive plate 35 is installed at the top of the containing groove 330 without being completely accommodated into the containing groove 330, so that the overall volume of the insulating base 33 can be minimized to provide a light and compact design to facilitate lowering the manufacturing cost and the warehouse storage and transportation costs. When the present invention is used, the lower conductive plate 35 and the upper conductive plate 321 are attached and contacted to produce a circuit connection, so that the current can be passed easily without generating heat easily, and the lower conductive plate 35 will not become brittle easily so as to improve the overall service life of the lampholder 3.

In summation, the push handle of the present invention is pushed to move reciprocally, so as to drive the lower conductive plate to move like a see-saw, and determine whether or not to electrically conduct the upper conductive plate. Therefore, the invention can achieve the effects of simplifying components, reducing the volume, controlling the light emitting element emit light, lowering the warehouse storage and transportation costs, and improving the service life of the lampholder effectively.

While the invention has been described by means of specific embodiments, numerous modifications and variations of the link rod mechanism could be made thereto by those skilled in the art without departing from the scope and spirit of the invention set forth in the claims.

In summation of the description above, the present invention improves over the prior art and complies with the patent application requirements, and is thus duly filed for patent application.

What is claimed is:

1. A push handle switch lampholder, comprising:

a cylindrical shell, formed by a conductive plate into a substantially cylindrical shape, and having a threaded mouth, and a containing space separately formed at the top and bottom of the interior of the cylindrical shell for screwing and connecting a light emitting element, such that a first electrode of the light emitting element is attached to the cylindrical shell for an electric conduction;

an insulating plate, installed at the bottom of the cylindrical shell, and having a connecting groove for passing and embedding an upper conductive plate, and the top of the insulating plate being exposed from the top end of the upper conductive plate and extended into the containing space of the cylindrical shell, and contacted with a second electrode of the light emitting element for an electric conduction, and the other end of the upper conductive plate being extended to the bottom of the insulating plate;

an insulating base, installed at the bottom of the insulating plate, and having a containing grove concavely formed at the top of the insulating plate and with a level penetrating through the top of the insulating plate;

a push handle, with a shape matched with the containing groove for being installed into the containing groove and performing a reciprocating push movement along the containing groove, and the push handle having a protruding portion protruded thereon; and a lower conductive plate, being substantially in a curved shape matched with the top edge of the containing groove for being movably fixed at a position of the containing groove corresponding to the protruding portion;

thereby, in the process of performing the reciprocating push movement by the push handle, the protruding portion of the push handle abuts a position proximate to the lower conductive plate, such that an end of the upper conductive plate is moved in a direction towards the upper conductive plate and contacted with the upper conductive plate to electrically connect and light up the light emitting element, and when the protruding portion abuts a position proximate to the other end of the lower conductive plate, an end of the lower conductive plate is moved in a direction away from the upper conductive plate and separated from the upper conductive plate to electrically disconnect and turns off the light emitting element.

2. The push handle switch lampholder of claim 1, wherein the insulating base includes a positive electrode plate and a negative electrode plate embedded into both sides of the containing groove respectively, and an end of the positive electrode plate is exposed from the top of the insulating base and extended to a position of the top of the containing groove proximate to the lower conductive plate, and the other end of the positive electrode plate is electrically coupled to a positive power supply line, and an end of the negative electrode plate is extended out from the top of the insulating base, and the other end of the negative electrode plate is electrically coupled to a negative electrode power line W1.

3. The push handle switch lampholder of claim 1, further comprising a connecting element, and at least one hole formed at corresponding position of the cylindrical shell, the insulating plate and the insulating base for passing the connecting element to secure the cylindrical shell, the insulating plate and the insulating base.

4. The push handle switch lampholder of claim 3, wherein the negative electrode plate is extended from a terminal at the top of the insulating base to a hole formed on the insulating base and proximate to the negative electrode plate, such that after the connecting element is passed through the hole, a terminal of the negative electrode plate is electrically coupled to the connecting element.

* * * * *